United States Patent [19]

Studtmann et al.

[11] Patent Number: 4,949,215

[45] Date of Patent: Aug. 14, 1990

[54] DRIVER FOR HIGH SPEED SOLENOID ACTUATOR

[75] Inventors: George H. Studtmann; Stanley B. Quinn, Jr., both of Mt. Prospect; Todd L. King, Buffalo Grove, all of Ill.

[73] Assignee: Borg-Warner Automotive, Inc., Troy, Mich.

[21] Appl. No.: 237,289

[22] Filed: Aug. 26, 1988

[51] Int. Cl.[5] ..... H01H 47/00

[52] U.S. Cl. ..... 361/154; 361/160

[58] Field of Search ..... 361/146, 152, 153, 154, 361/160, 170, 186, 187

[56] References Cited

U.S. PATENT DOCUMENTS 4,114,184 9/1978 Stampfi ..... 361/154
4,173,030 10/1979 Rabe ..... 361/154
4,310,868 1/1982 Lillie et al. ..... 361/154
4,578,734 3/1986 Delbossse ..... 361/153
4,720,762 1/1988 Estes ..... 361/154

*Primary Examiner*—Philip H. Leung
*Assistant Examiner*—Jeffrey A. Gaffin
*Attorney, Agent, or Firm*—Neuman, Williams

[57] ABSTRACT

A method and apparatus for solenoid driver control of high speed solenoid actuators which includes supplying a high regulated level of acceleration current to operate the actuator, monitoring and controlling the current requirements of solenoid actuation, automatically reducing the solenoid current at a rapid rate to a lesser level of regulated solenoid hold current for the remaining duration of actuator operation, and rapidly reducing the solenoid current between acceleration and holding levels and for rapid solenoid release. Current is controlled at the different levels using switch mode power control techniques for power efficiency.

50 Claims, 7 Drawing Sheets

DRIVER FOR HIGH SPEED SOLENOID ACTUATOR

BACKGROUND OF THE INVENTION

The present invention relates to high speed solenoid actuators, referred to herein as "solenoids", and more particularly to methods and apparatus for controlling electronic systems which drive such high speed solenoids.

In order to design high speed solenoids for solenoid control systems, it is necessary to provide electronic control systems capable of driving such solenoids at very high speeds with high efficiency and with nominal average current requirements, particularly as applied to pulse width modulated (PWM) solenoid valve applications. Present PWM solenoid valves are limited to a maximum frequency of operation on the order of 100 to 150 Hz, with open to close travel times on the order of 1.5 milliseconds. The present invention makes possible the design and operation of PWM solenoid valves at frequencies of 400 Hz and above with open to close travel times of the order of 400 microseconds.

In order to design a high speed driver it is first necessary to understand some fundamental concepts of solenoid design. The force developed by a solenoid, for a given gap and neglecting saturation, is proportional to the square of the product of the turns and the current passing through the solenoid coil. To increase the rise time of the force it is necessary to increase the rise time of the current. The rise time of the solenoid current, neglecting eddy currents, circuit resistance, and back electromotive force (emf), is inversely proportional to the applied potential and directly proportional to the solenoid inductance. If the applied potential is fixed, then the inductance must be decreased by decreasing the number of turns on the solenoid coil. However, to maintain the same force level, the current must be increased.

It may be shown that the rise time of the solenoid is proportional to the number of turns for the conditions assumed above. That is, if the turns are cut in half, the current to obtain the same force will be doubled and the inductance will be one fourth of the original value. If the inductance is reduced four times, then a time T to reach the original value of current is reduced to T/4. However, the current must be doubled to produce the original force so an additional increment of time T/4 is required. Therefore the new rise time is one half of the original.

If the solenoid current rises at a sufficiently high rate, it can attain its maximum prescribed level before significant solenoid armature motion occurs. Back emf which is generated due to solenoid armature movement then has almost no effect on solenoid current during its rise period. Consequently, more solenoid force can be supplied during the period of solenoid current rise if the solenoid has a current rise time significantly less than the solenoid armature response time, so that back emf due to solenoid armature motion becomes insignificant.

To attain a very high speed solenoid the inductance must be made low enough so that the desired rise time may be achieved. This implies using very few turns, and hence the coil resistance is very small. Therefore, the steady state current must be limited by external circuit means.

Another requirement to achieve high speed operation is the minimization of eddy currents in the metal parts of the solenoid. This may be done by using appropriate magnetic laminations to restrict the flow of the eddy currents.

To effectively drive the high speed solenoid the electronic driver must use a fast acting solid state switch such as a MOSFET. This switch must be capable of turning on rapidly to apply the input potential, less any switch drop, directly across the solenoid to achieve the rapid rise of current. The driver must then be capable of efficiently limiting the solenoid current as described above. As explained below, it may be necessary to provide more than one level of current as well as a means of achieving rapid transition between these levels.

OBJECTS OF THE INVENTION

Accordingly, one object of the present invention is to provide a controller that can rapidly apply essentially full excitation potential to a high speed solenoid to cause rapid buildup of current and force.

Another object of the present invention is to provide a means of limiting current to the solenoid at prescribed levels in an essentially non-dissipative manner.

Yet another object of the present invention is to provide a means of allowing rapid transition of the current and force between the prescribed levels.

Still another object of the present invention is a high speed solenoid drive source which provides a pulsed output and combines high drive pulse currents and holding currents with good efficiency and low average current.

A further object of the present invention is to reduce the current rise time of a solenoid to allow solenoid current to achieve a maximum prescribed level before significant solenoid armature motion occurs, to reduce solenoid back emf and thereby increase initial solenoid force.

SUMMARY OF THE INVENTION

The above described objects, as well as other advantages described herein, are secured with methods and apparatus for solenoid driver system control of high speed solenoids which include supplying a high level surge of solenoid current to initiate and complete solenoid actuation, monitoring current requirements of solenoid actuation, automatically reducing the solenoid current to a lower holding level after the solenoid is fully actuated, and rapidly reducing the solenoid current between acceleration and holding levels and for rapid solenoid release.

DESCRIPTION OF THE PREFERRED EMBODIMENT

Figure 1:
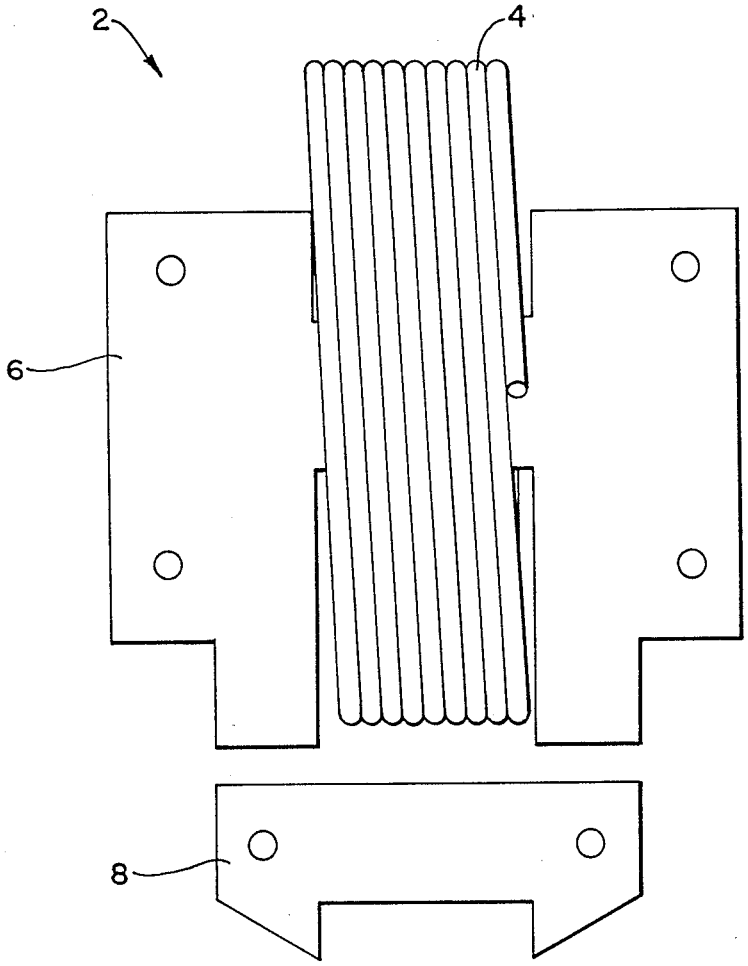
FIG. 1 is a high speed solenoid actuator suitable for use with the present invention.

The present invention includes a special power source switching system for processing and control to secure both high operation efficiency and rapid solenoid control for high speed solenoid control systems. Referring to the drawings, wherein reference characters designate like or corresponding parts throughout the views, FIG. 1 shows a simple configuration for energizing a high speed solenoid. One application for which this system is uniquely suited is shown, described and claimed in a patent application, filed of even date herewith, entitled "Solenoid Operated Hydraulic Control Valve," in the names of Alan L. Miller, George H. Studtmann, Todd L. King, Kenneth R. Gallaher, Jerome J. Zawada, Jr. and William P. Umlauf.

The present invention is primarily intended for operation of high speed solenoid actuators which have special electric and magnetic circuits to maintain high force levels with reduced actuation response times. Referring to the drawings, wherein reference characters designate like or corresponding parts throughout the views, FIG. 1 shows one such solenoid actuator which is suitable for operating frequencies up to at least 400 Hz. A solenoid actuator assembly 2 includes a solenoid coil 4, a stator 6 and an armature 8. The stator 6 is shown as a "C" type, but may have another configuration, such as an "E" types, in which case its solenoid coil is wound around the central pole piece of the stator. The "C" type structure is preferred because it is less sensitive to armature-stator misalignment. When the armature of the "E" type structure is cocked relative to the stator, the magnetic forces across the gaps of the outer pole pieces change to accentuate the imbalance, increasing the misalignment still further. This cannot happen with the "C" type structure, since the gaps are in series with each other.

To achieve rapid buildup of solenoid force and current, it is necessary to minimize eddy currents. Therefore, the stator 6 and the armature 8 both include laminated construction. For operation of the solenoid actuator 2 at a frequency in the range of about 400 Hz, laminations of ferromagnetic plates, each with a thickness up to about of 0.014 inch, to form laminated structures for the stator 6 and the armature 8 on the order of about 0.25 inch are very suitable. An armature to stator gap in the range of about 0.005 to 0.010 inch fully opened is also recommended to retain maximum efficiency. A low inductance coil, such as about 26 turns of no. 19 wire, may be wound around the yoke of the stator as shown, or alternatively, two smaller coils can be utilized, with each coil having half as many coil turns and each wound around a different pole piece of the stator 6. Furthermore, the stator 6 and armature 8 can have ferromagnetic tape wound structures rather than the laminated construction described above.

The solenoid 2 described above has a sufficiently low current rise time so that little solenoid armature motion occurs before solenoid current reaches a maximum prescribed value for driving the solenoid 2. This is because its current rise time is substantially less than its armature response time. Thus, solenoid back emf is low during this period, allowing initial solenoid force to be as high as possible.

Figure 2:
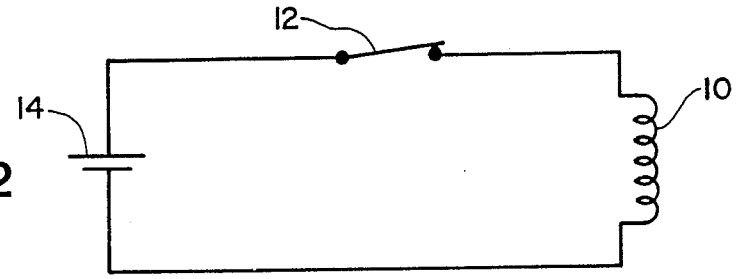
FIG. 2 is a simple circuit configuration for energizing a solenoid.
Figure 3:
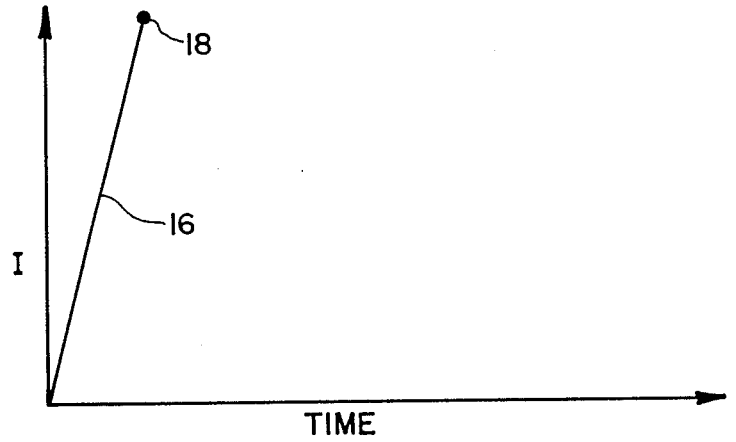
FIG. 3 is a graphical representation of transient solenoid current as a function of time for the circuit configuration of FIG. 2 during the period of initial energization.

FIG. 2 shows a simple configuration for energizing a solenoid. A solenoid 10 is actuated by the application of electric current controlled by a power switch 12, which current is supplied by a power source 14. This configuration results in the rise of current in the solenoid 10 which is very rapid. A graphical representation of solenoid current for a very fast acting solenoid, as a function of time, during a short period after energization for the solenoid configuration of FIG. 2 is shown in FIG. 3 by line 16. The effect of solenoid resistance is negligible during this period, and back emf is very small because the current rises to its maximum prescribed level, represented by a point 18, before the armature for the solenoid 10 can move appreciably. Therefore, the slope of the line 16 is given by the potential supplied by the power source 14 across the solenoid 10 coupled with the inductance of the solenoid 10, according to the well known relationship, $$\frac{dI}{dt} = \frac{e}{L}$$

wherein I is solenoid current, e is potential across the solenoid, t is time and L is solenoid inductance.

A time T, for the solenoid current to rise from zero to a value I, with a potential of value E across the solenoid and solenoid inductance L is given by $$T = \frac{L\Delta I}{E}$$

Assuming a given value of potential E it is necessary to reduce L if T is to be reduced. However, the solenoid current must then be increased to maintain the same solenoid force.

As explained above, in the case of a very fast acting solenoid, the inductance may be reduced to the point where the solenoid current and force rise to their maximum values before the plunger of the solenoid and its connected load travel the required distance. Such a maximum solenoid current level is represented by the point 18 in FIG. 3. Therefore, it may be necessary to provide a high level drive current for a time sufficiently long enough to assure that the travel is completed.

Figure 4:
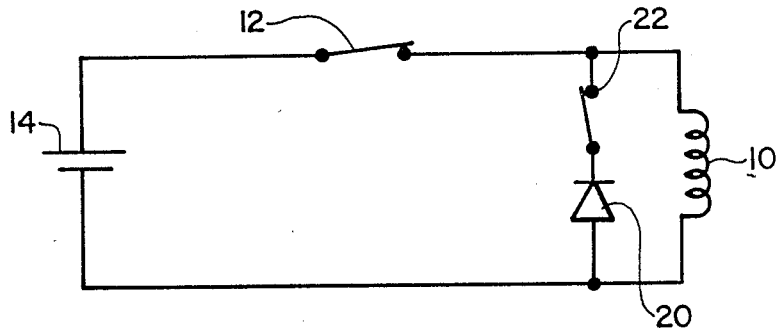
FIG. 4 is a simple circuit configuration for holding solenoid current at a specific current level with a slow decay.

Therefore, it has been found desirable to use switched mode operation to control the solenoid current supplied by the power supply after the desired solenoid current is reached. This may be done using the circuit configuration shown in FIG. 4. This circuit includes the solenoid 10 with solenoid current controlled by the power switch 12 from the power source 14, just as described above for the circuit shown in FIG. 2, but it additionally includes a diode 20 which is selectively placed in parallel with the solenoid 10 by a freewheel switch 22.

When the freewheel switch 22 is closed, and the power switch 12 is then closed to allow current from the power source 14 to flow through the solenoid 10, solenoid current rises as shown in FIG. 3, the same as for the circuit shown in FIG. 2. However, when the required level of solenoid current is reached, the power switch 12 is opened. Even though the power source 14 then ceases to supply current to the solenoid 10, current generated by the decaying magnetic field of the solenoid 10 continues to flow with the circuit return provided by the diode 20 and the closed freewheel switch 22. Solenoid current is free to pass along this circuit return because the power source 14 cannot reverse bias the diode 20 when the power switch 12 is open.

Figure 5:
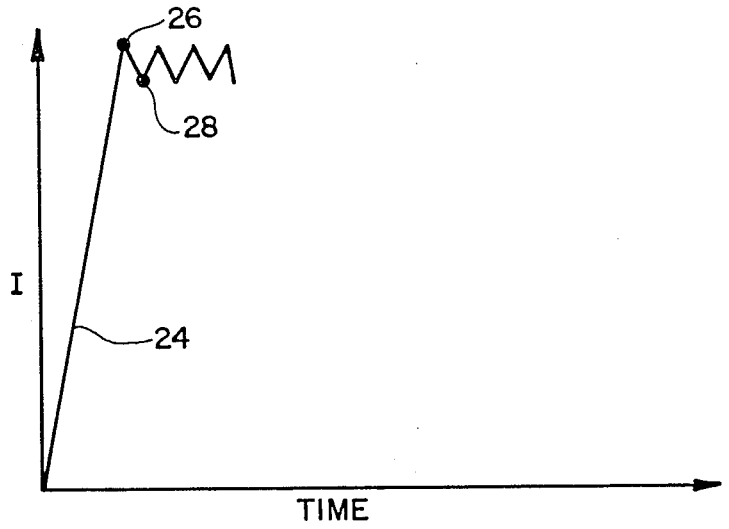
FIG. 5 is a graphical representation of solenoid current as a function of time for the circuit configuration of FIG. 4.

Of course, due to circuit losses, the solenoid current will diminish over time after the power switch 12 is opened. The power switch 12 is periodically closed to maintain a minimum level of solenoid current. FIG. 5 is a graphical representation of this circuit operation, with a line 24 representing solenoid current through the solenoid 10 as a function of time. Because of relatively low circuit resistance, solenoid current increases linearly up to a point 26, which represents the desired maximum current level. After solenoid current reaches this maximum level, the power switch 12 is opened, and the solenoid current is shunted through the diode 20 and diminishes to a minimum current level represented by a point 28. The power switch 12 is then periodically closed and opened to maintain solenoid current between these two levels as long as the solenoid 10 requires acceleration current.

Operation in this switch mode results in operation as a DC to DC converter in which the average input power is equal to the average output power, neglecting stray resistive and switching losses. This means that essentially $$\bar{E}_{in} \cdot \bar{I}_{in} = \bar{E}_{out} \cdot \bar{I}_{out}$$

and $$\bar{I}_{in} = \frac{E_{out}}{E_{in}} \cdot \bar{I}_{out}$$

where the potentials and currents are average quantities.

Since the since the solenoid 10 has a very few coil turns the ratio of $\bar{E}_{out}/\bar{E}_{in}$ is relatively small, which means that the average input current is reduced from the average output current by the same ratio. Therefore, even though $\bar{I}_{out}$ may be high, the average DC input current, $\bar{I}_{in}$, is maintained at relatively low level. Also, since only switching losses and resistive losses are involved, the efficiency of operation is very high compared to the case where the current is limited by a transistor operating in its linear region.

Once the solenoid plunger is driven to the fully actuated low reluctance condition, less current is required to hold the actuator in the fully actuated condition than for initial acceleration. Therefore, a solenoid holding current level which is less than the solenoid acceleration current level can be established which is satisfactory to maintain the actuator in the fully actuated condition, and yet is substantially more economical of power supply current. This change in solenoid current is secured according to the present invention with the circuit configuration shown in FIG. 6. This circuit is exactly the same as described above for the circuit shown in FIG. 4, except that a diode 30 is serially connected with a zener diode 32 across the solenoid 10.

The operation of the circuit is similar to that described above for the circuit shown in FIG. 4, except that after the solenoid operated actuator is driven to the fully actuated, low reluctance condition, the power switch 12 and the freewheel switch 22 for the low impedance shunt current path through the diode 20 are both opened. Solenoid current continues to flow through the diode 30 and across the zener diode 32. The potential breakdown value of the zener diode 32 may be selected to determine the rate at which the solenoid current decays. A time T required for the solenoid current to decay an amount $\Delta I$, neglecting resistance and back emf, is given by $$T = \frac{L\Delta I}{E_z}$$

where $E_z$ is the zener potential and L is the solenoid inductance. Thus, the solenoid current will decay faster as $E_z$ is increased. After the desired holding current is established, the freewheel switch 22 is closed and the power switch 12 is periodically closed to maintain the desired solenoid holding current level.

Figure 7:
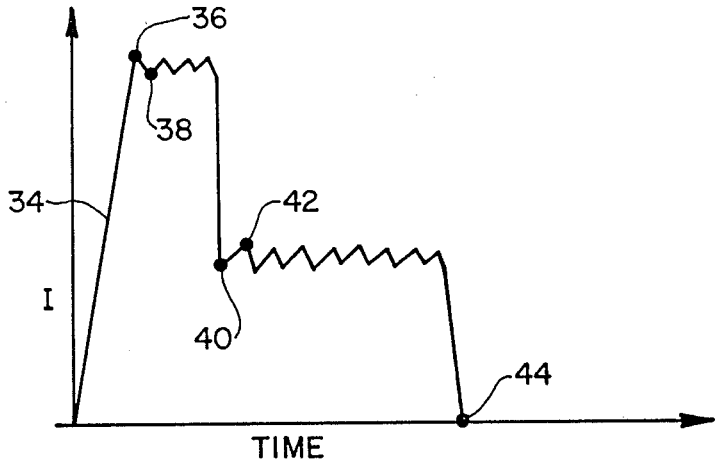
FIG. 7 is a graphical representation of solenoid current as a function of time for the circuit configuration of FIG. 6.

FIG. 7 is a graphical representation of this circuit operation, with a line 34 representing solenoid current through the solenoid 10 as a function of time. After increasing to a maximum desired solenoid drive level represented by a point 36 and a minimum desired drive level represented by a point 38, with the operation of the power switch 12 and freewheel switch 22, as explained above, the solenoid current then drops to the minimum desired solenoid holding level represented by a point 40 after the freewheel switch 22 is held open. Then the freewheel switch 22 is again closed and the power switch 12 is periodically closed to maintain the solenoid current between the minimum holding level represented by the point 40 and the maximum holding level represented by a point 42. Operation in this region is similar to that previously described for the high current region following point 36 of FIG. 7. The DC to DC converter operation in this region again allows significant holding currents to be supplied with relatively small holding average input current. For the case of a 400 Hz solenoid as described above in connection with FIG. 1, when the "on" time is about 95% of the total cycle, the average input DC current is on the order of 1.0 ampere for a 7.5 ampere holding current. Finally, after the desired period for maintaining the solenoid holding current has elapsed, the power switch 12 and the freewheel switch 22 are both opened to let the solenoid current rapidly fall to zero at a time represented by a point 44, as shown in FIG. 7.

Figure 6:
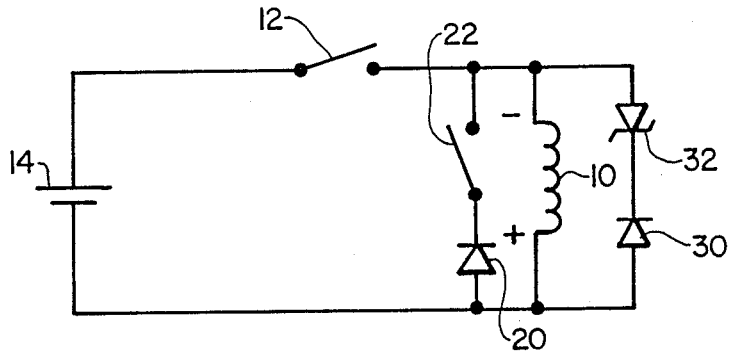
FIG. 6 is a simple circuit configuration for securing two distinctly different solenoid current levels over a period of time and enabling rapid transitions between them.
Figure 8:
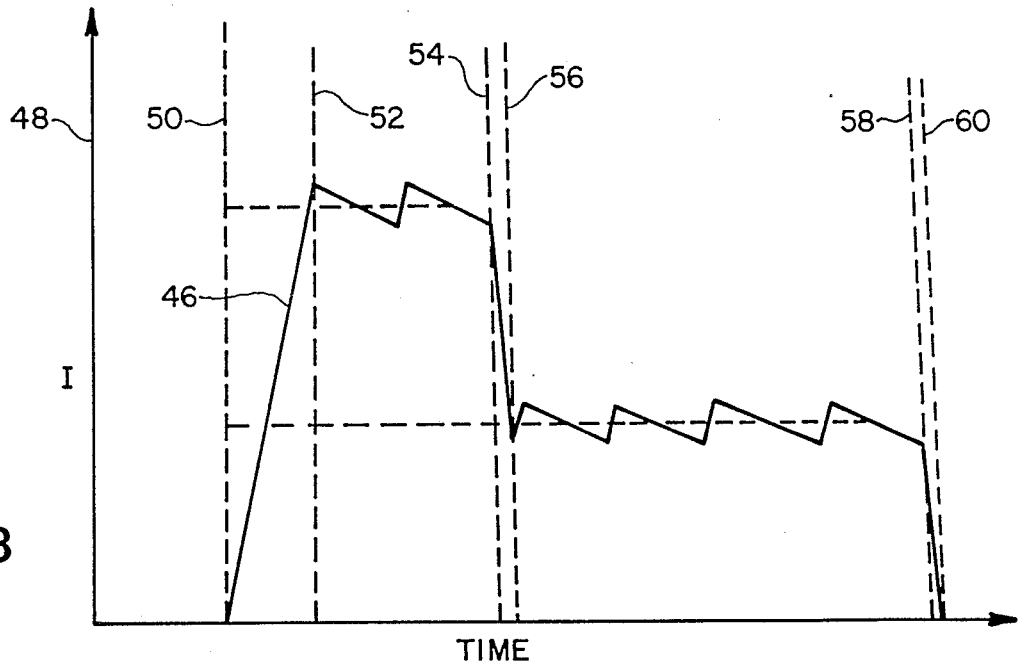
FIG. 8 is a detailed graphical representation of a desirable solenoid current driver circuit characteristic in accordance with the present invention as a function of time for actuation, holding and deactivation.

The circuit of FIG. 6 can be used to properly control a solenoid for a high speed solenoid operated actuator if the power switch 12 and the freewheel switch 22 are properly sequenced. The required sequence of switch operations may be summarized by referring to FIG. 8 in connection with the Table. A line 46 in FIG. 8 represents the desired amplitude of solenoid current as a function of time. The line 46 is divided into several regions, corresponding to different operations performed by the circuit of FIG. 6 in response to switching sequences of the power switch 12 and the freewheel switch 22. These regions are indicated by the line sections of the line 46 between a zero time axis 48 and dashed lines 50, 52, 54, 56, 58 and 60.

The region between the zero time axis 48 and the dashed line 50 corresponds to circuit mode one in the Table. In this interval, the solenoid current is zero, and the solenoid operated actuator remains in its normally quiescent state. For circuit mode one, both the power switch 12 and the freewheel switch 22 are in the open position. The solenoid 10 is energized in mode two with its current corresponding to the line 46 in the region between the dashed lines 50 and 52. This interval corresponds to the steep rise in solenoid current from zero to the maximum desired acceleration level, when the solenoid 10 must begin to rapidly accelerate its load. The load comprises the solenoid plunger or armature and any coupled mass, such as a value stem.

The rapid rate of rise in solenoid current during mode two is followed by an interval of relatively constant high solenoid current in mode three, represented by the line 46 in the region between the dashed line 52 and the dashed line 54. The solenoid has this high value of current applied to it to maintain the large force to insure that the load completes its travel. To maintain this relatively high value of current, the freewheel switch 22 is kept closed, and the power switch 12 is intermittently closed at periodic intervals to keep the average value of the solenoid current at a desired solenoid drive level. The power switch 12 is opened to let the solenoid current fall to a minimum desired acceleration level, and then closed until the solenoid current once again reaches the maximum acceleration level. This switch operation of the power switch 12 is periodically repeated during the entire interval of the region between the dashed line 52 and the dashed line 54 to insure that the solenoid is driven to the fully actuated state.

However, the high level of solenoid acceleration current is not necessary when the solenoid 10 reaches its fully actuated position. The high level of drive current is required primarily to accelerate the solenoid 10 rapidly. Once the actuator is fully actuated, a much lower value of solenoid current is sufficient to hold the solenoid in place. Therefore, mode three is followed by an interval of rapid solenoid current decay in mode four, represented by the line 46 in the region between the dashed line 54 and the dashed line 56. This rapid solenoid current decay is achieved by opening both the power switch 12 and the freewheel switch 22 until the solenoid current decays to a minimum desired solenoid hold current level.

The rapid decay of solenoid current in mode four is followed by an interval of relatively constant moderate solenoid holding current in mode five, represented by the line 46 in the region between the dashed line 56 and the dashed line 58. This interval extends for whatever period the solenoid is left in the actuated position. To maintain this moderate value of solenoid current, the freewheel switch 22 is kept closed, and the power switch 12 is intermittently closed at periodic intervals to keep the average value of the solenoid current at a desired solenoid holding level. The power switch 12 is closed to let the solenoid current rise to a maximum desired solenoid hold level, and then opened to let the solenoid current fall to a minimum desired solenoid holding level. This cyclical switch operation of the power switch 12 is periodically repeated during the entire interval of the region between the dashed line 56 and the dashed line 58.

After the solenoid is held in the actuated position for the desired period, the solenoid should be rapidly returned to its released position by reducing the solenoid current to zero. Therefore, mode five is followed by an interval of rapid solenoid current decay in mode six, represented by the line 46 in the region between the dashed line 58 and the dashed line 60. This rapid current decay is achieved by once again opening both the power switch 12 and the freewheel switch 22 until the solenoid current drops to zero. The circuit is then in mode one, and may proceed through the above described modes one through six for additional solenoid operation.

In order to sense the current actually developed in the solenoid when the solenoid is actuated, some means for developing a feedback signal is desirable. Such feedback is provided in the circuit shown in FIG. 9. This circuit is similar to that shown in FIG. 5, and includes the solenoid 10, the power switch 12, the power source 14, the diode 20, the freewheel switch 22 and the zener diode 32. However, the zener diode 32 is connected across the power switch 12 in series with the power source 14 so that the diode 30 included in the circuit of FIG. 6 is not needed. Feedback potential is developed across a small feedback resistor 62, which is in series with the solenoid 10. The developed feedback potential across the resistor 62 is therefore proportional to current through the solenoid 10.

Figure 9:
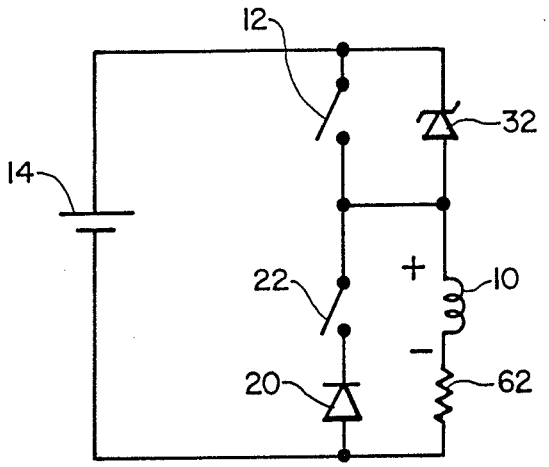
FIG. 9 is a solenoid current driver circuit in accordance with the present invention including a source of solenoid current, feedback.
Figure 10:
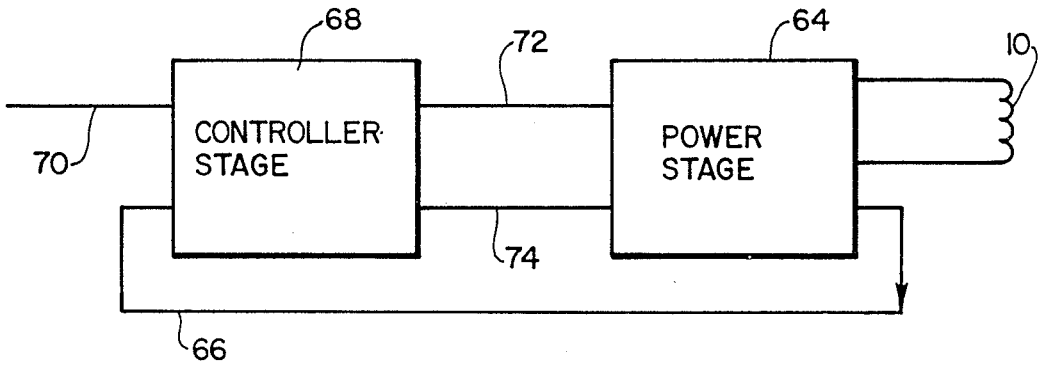
FIG. 10 is a block diagram of a preferred embodiment of a complete solenoid operated actuator driver system according to the present invention, including controller and power stages.

A controller stage may be added to the circuit of FIG. 9 to provide a complete solenoid control system. A block diagram of such a control system is shown in FIG. 10. A driver stage 64, such as that shown in FIG. 9, drives the solenoid 10. The driver stage also provides a feedback potential, as described above, on a line 66. A control signal, such as a width modulated pulse of constant amplitude, having a duration corresponding to the duration that the solenoid 10 should be operated, is fed to a controller stage 68. Of course, the controller 68 could also accept another type of control signal, such as a binary coded decimal signal which has the desired solenoid actuation period digitally encoded. In any case, the controller stage 68 also accepts the feedback signal on the line 66 from the driver stage 64. The controller stage 68 senses the current supplied by the driver stage 64 to the solenoid 10. The controller 68 responds to the control signal on a line 70 and the feedback signal on the line 66 with output signals on lines 72 and 74, which are representative of the desired states of the power switch 12 and the freewheel switch 22 respectively. The sequencing of the output signals on the lines 72 and 74 correspond to the open and closed designations for the power switch 12 and the freewheel switch 22 columns listed in the Table, as described above.

Figure 11:
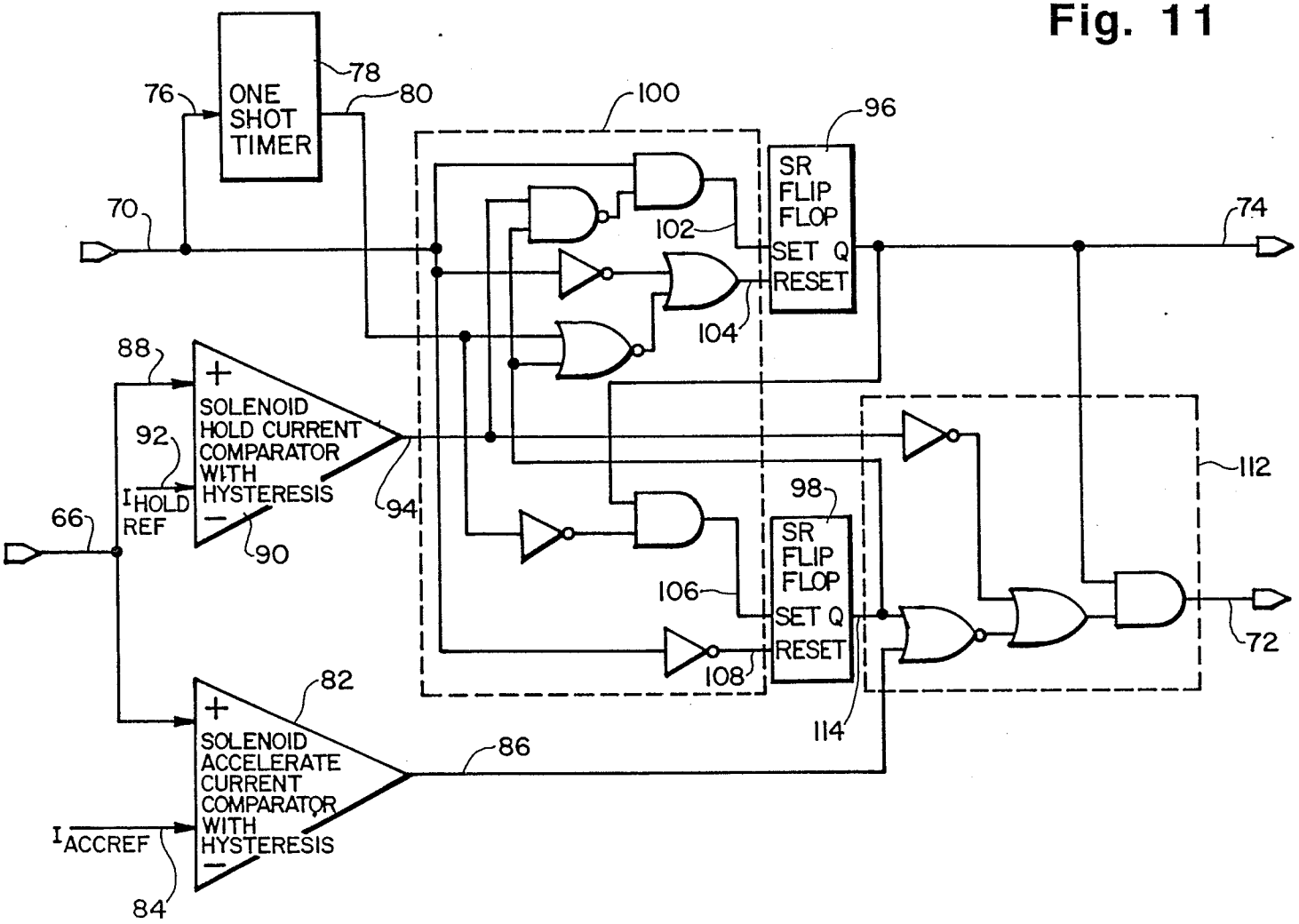
FIG. 11 is a logic diagram of an embodiment of the controller stage shown in FIG. 10.

A logic diagram of a simplified embodiment of the controller 68 shown in FIG. 10 is shown in FIG. 11. A pulse width modulated (PWM) control signal as described above in connection with FIG. 10 is fed on a line 76 from line 70 to a one-shot timer 78. When the control signal switches to a high level, or "1" state, indicating the leading edge of a pulse, the output of the one shot timer 78 switches to the "1" state on a line 80 for the duration equal to the time required to fully actuate the solenoid plunger.

A feedback signal on the line 66 from the power stage 64 of FIG. 10 is fed to an acceleration level comparator 82. The acceleration level comparator 82 compares the feedback signal on the line 66 to a reference acceleration level on a line 84 to determine if the feedback signal is above or below the reference acceleration level. The acceleration level comparator 82 includes a hysteresis characteristic so that it produces an output on a line 86 with a high level, or "1" state, when the potential of the feedback signal exceeds the potential of the reference acceleration level, but will not return to a low level, or "0" state, until the feedback signal potential falls below the reference acceleration level potential by a small increment. This increment corresponds to the difference between the current levels represented by the points 36 and 38 in FIG. 7 multiplied by the resistance of the feedback resistor 62 shown in FIG. 9.

The feedback signal is also fed on a line 88 from the line 66 to a holding level comparator 90 which compares the feedback signal to a reference holding level on a line 92 to determine if the feedback signal is above or below the reference holding level. The holding level comparator 90 also includes a hysteresis characteristic so that it produces an output on a line 94 with a high level, or "1" state, when the potential of the feedback signal exceeds the potential of the reference hold level, but will not return to a low level, or "0" state, until the feedback signal potential falls below the reference hold level by a small increment. This increment corresponds to the difference between the current levels represented by points 40 and 42 in FIG. 7 multiplied by the resistance of the feedback resistor 62 in FIG. 9.

The controller 68 also includes a first flip-flop 96 and a second flip-flop 98 to maintain the internal state of the controller 68. The first flip-flop 96 and the second flip-flop 98 are controlled by a flip-flop logic control circuit 100. The flip-flop logic circuit 100 sets the first flip-flop 96 with a "1" state on a line 102 and resets it with a "1" state on line 104. The flip-flop logic circuit 100 sets the second flip-flop 98 with a "1" state on a line 106 and resets it with a "1" state on a line 108. The inputs to the flip-flop logic circuit 100 are controlled by logic states fed by the lines 70, 80 and 94, as well as the output of the first flip-flops 96, 98 on a line 110. The outputs of the flip-flop 96 also feeds the line 74.

The flip-flop logic circuit 100 resets the outputs of the flip-flops 96, 98 to the "0" state when the state of the control signal on line 70 is also "0". Consequently, the logic state present on the line 74 is then a "0" state. The line 72 is fed by the output of an output logic circuit 112. The inputs of the output logic circuit 112 are fed by the lines 86 and 94 from the acceleration level comparator 82 and the holding level comparator 90 respectively, as well as the line 110 from the output of the first flip-flop 96 and a line 114 from the output of the second flip-flop 98. The logic of the output logic circuit 112 causes the logic state on line 72 to be a "0" state when the control signal on the line 70 has a "0" state. This condition, with both lines 72 and 74 having the "0" state, corresponds to mode one in the Table, with both the power switch 12 and the freewheel switch 22 opened.

When the control signal on the line 70 switches to the "1" state, the first flip-flop 96 is set. Thus, the logic state on the line 74 becomes "1", and since the lines 94 and 114 have a "0" state, the line 72 has a "1" state, corresponding to mode two in the Table, with the power switch 12 being closed. When the solenoid current rises to the level represented by the point 36 in FIG. 7, the acceleration level comparator 82 switches its output to the "1" state, causing the state on the line 72 to become "0". Because the line 74 is still in the "1" state, the solenoid current decays slowly until it falls to a level represented by the point 38 in FIG. 7, at which point the acceleration current comparator 82 switches its output to a "0" state on the line 86, which causes the logic output circuit 112 to change its state to "1" on the line 72. This cycle repeats as long as the one shot timer 78 output has a "1" state on the line 80, corresponding to mode three in the Table. The duration of the one shot timer 78 pulse in the "1" state thus sets the time interval over which the solenoid plunger is accelerated to pull it in.

When the one shot timer 78 changes its output state to "0" on the line 80, indicating the end of the acceleration current period, the first flip-flop 96 is reset and the second flip-flop 98 is set. The output of the first flip-flop 96 then has a "0" state on the line 110 and the second flip-flop 98 has an output with a "1" state on the line 114. The "0" state on the line 110 causes the output logic circuit 112 to switch to a "0" state on the line 72. Thus, the solenoid current falls rapidly until it reaches the level represented by the point 40 in FIG. 7.

After the solenoid current reaches the level represented by the point 40 in FIG. 7, the holding level comparator 90 switches its output to a "0" state on the line 94, and this causes the flip-flop logic circuit 100 to set the first flip-flop 96. Since the second flip-flop 98 is also set, the output of the output logic circuit 112 switches to a "1" state on the line 72. The solenoid current then increases to a level represented by the point 42 in FIG. 7, at which level the holding comparator 90 switches its output to a "1" state on the line 94, causing the output of the output logic circuit 112 to switch to a "0" state on the line 72. The solenoid current then decreases slowly until it falls to the level represented by the point 40 in FIG. 7, and the cycle repeats as indicated in mode five of the Table.

Mode five is interrupted when the control signal on the line 70 changes to a "0" state, which causes the flip-flop logic circuit 100 to reset the first flip-flop 96 and the second flip-flop 98, causing their outputs to both switch to the "0" state on lines 110 and 114 respectively, in turn changing the signals on lines 72 and 74 to the "0" state, causing the solenoid current to decay rapidly. This condition corresponds to mode six in the Table. When the solenoid current reaches the zero level, the controller 68 is once again in the mode one condition, ready for another control signal pulse on the line 70.

Figure 12:
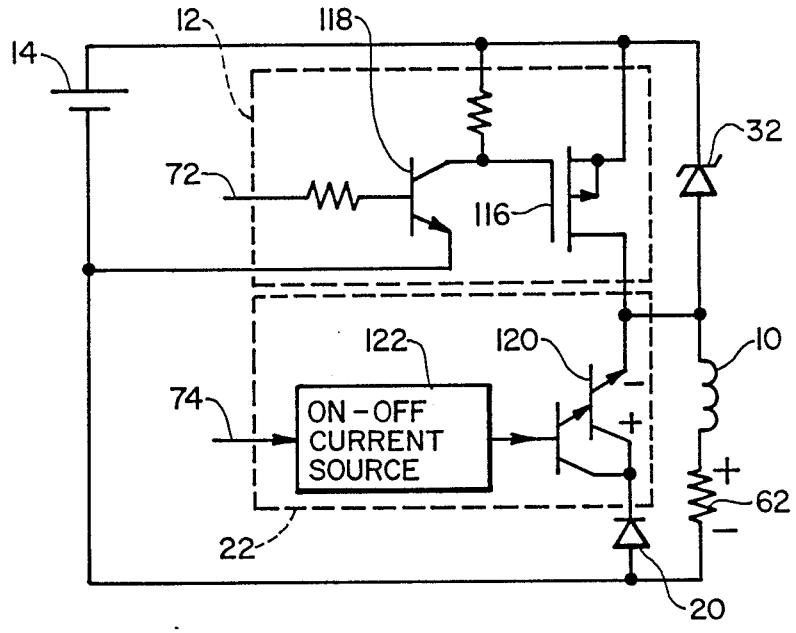
FIG. 12 is a specific implementation of the circuit configuration shown in FIG. 9.

Although the power switch 12 and the freewheel switch 22 in the circuit of FIG. 9 may be activated by the controller stage 68 as described above with a variety of known devices, such as relays or transistors, a convenient circuit for using transistor switching for the circuit of FIG. 9 is shown in FIG. 12. This circuit includes the solenoid 10, the power source 14, the diode 20, the zener diode 32 and the feedback resistor 62 shown in the circuit of FIG. 9. The power switch 12 of FIG. 9 comprises a P-channel MOSFET 116 driven by an NPN bipolar transistor 118. Base drive for the driver transistor 118 is provided by the output on the line 72 from the controller 68 described above. The freewheel switch 22 comprises a Darlington transistor 120. The transistor 120 is base driven by an on-off current source 122 controlled by the output on line 74 from the controller 68 described above.

The circuit configuration shown in FIG. 12 is very simple and easily implemented, but it suffers from circuit losses which result in slower overall system response and suboptimal efficiency. These circuit losses are due to the power loss through the transistor 116 when it is conducting, the power loss through the zener diode 30 when the transistors 116 and 120 are not conducting, and the power loss through both the transistor 120 and the diode 20 when transistor 116 is not conducting, but transistor 120 is conducting. The power loss through the transistor 116 in this case is the square of the current through the solenoid 10 multiplied by the saturated drain to source potential of the transistor 116. The power loss through the transistor 120 and the diode 20 is the current through the solenoid 10 multiplied by the combination of the emitter to collector saturation potential of the transistor 120 and the potential drop of the diode 20. Loss in the zener diode 30 is the solenoid current multiplied by its breakdown potential.

Figure 13:
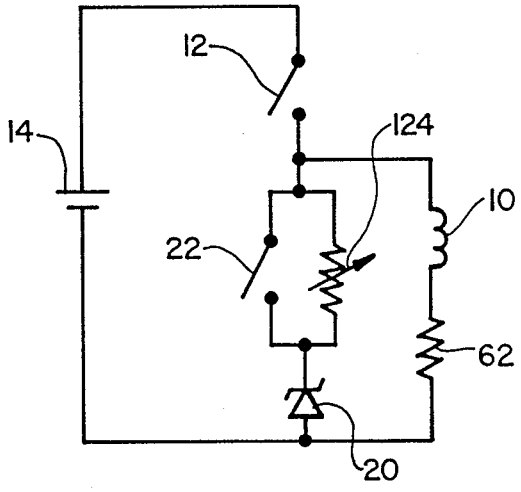
FIG. 13 is a preferred embodiment of the power stage for the solenoid driver system shown in FIG. 9.

An alternative and preferred circuit arrangement for the power stage 64 which reduces the above described circuit losses is shown in FIG. 13. It includes the power source 14, the power switch 12, the freewheel switch 22, the diode 20, the solenoid 10 and the feedback resistor 62 shown in the circuit of FIG. 8. However, the diode 20 is of the Schottky type to allow a lower freewheel voltage, and the zener diode 32 is removed. The function of the zener diode 32, to rapidly decay the solenoid drive current level down to the solenoid hold current level, and to decay the solenoid hold current level to zero, is replaced by a controllable variable resistance 124 across the freewheel switch 22. Fast decay energy in the circuit is thereby dissipated in the variable resistance 124 to ground rather than through the zener diode 32 to the power source 14. Losses are thus reduced by the product of the solenoid current and the potential of the power source 14 in modes 4 and 6.

Figure 14:
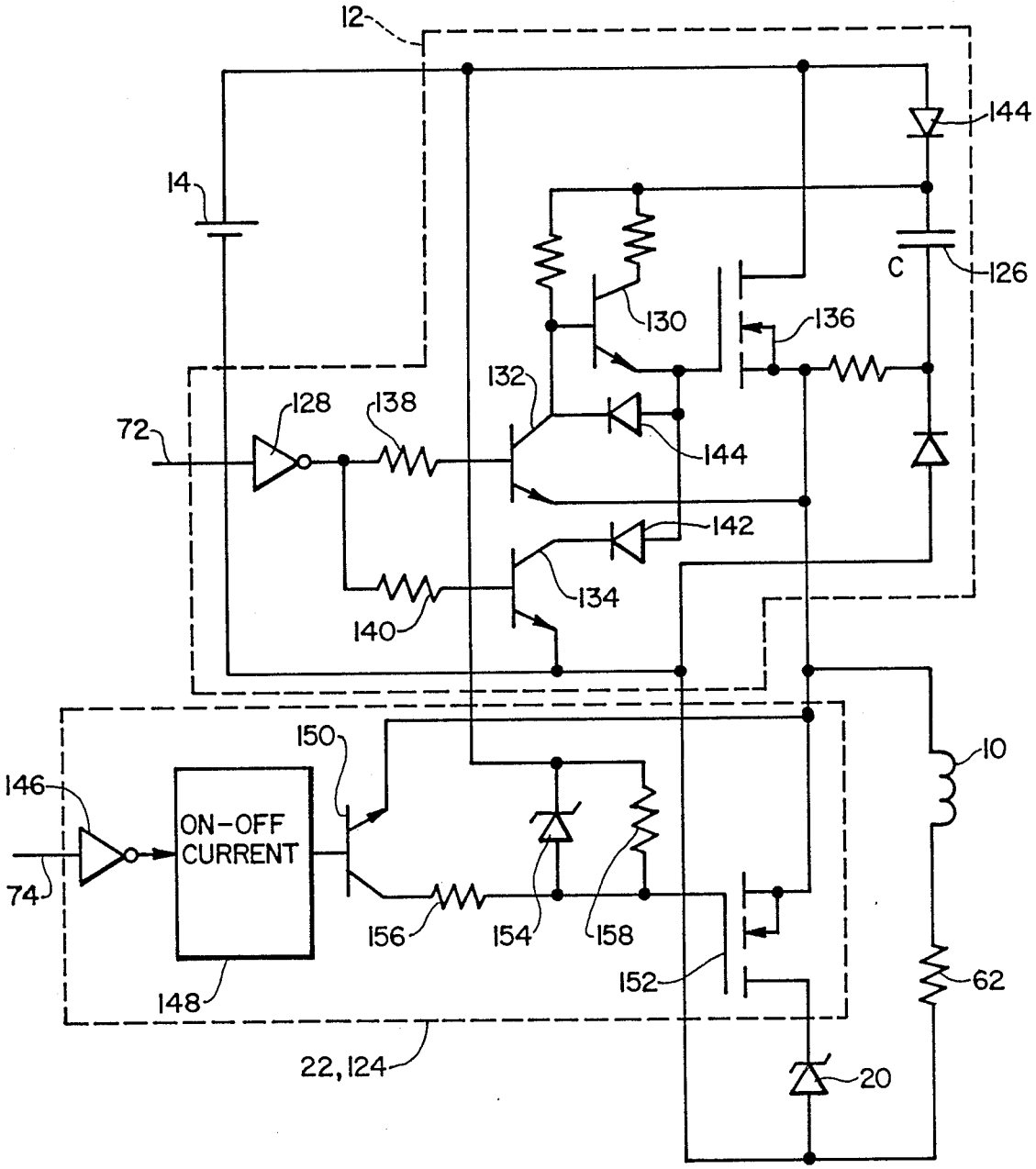
FIG. 14 is a specific implementation of the circuit configuration shown in FIG. 13.

The power switch 12, the freewheel switch 22 and the variable resistance 124 may all be implemented with a variety of different arrangements, but one convenient arrangement is shown in FIG. 14. This circuit includes the power source 14, the solenoid 10, the feedback resistor 62 and the diode 20 shown in FIG. 13. The power switch 12 comprises the circuit including a capacitor 126, a first inverter 128, bipolar NPN transistors 130, 132 and 134, and an N channel MOSFET transistor 136. The first inverter 128 inverts the output on the line 72 from the controller stage 64 described above to provide an inverted value of the line 72 output on the bases of the transistors 132 and 134 through current limiting resistors 138 and 140, respectively. The transistors 132 and 134 have their collectors connected to the gate of the transistor 136 and the emitter of the transistor 130 through diodes 142 and 144 respectively.

When the line 72 output has a value of "0", the transistors 132 and 134 are both conducting, so that the emitter of transistor 130 and the gate of the transistor 136 are both at zero potential through the transistor 134, or negative potential through the transistor 132, since the transistor 134 has its emitter converted to the zero potential side of the power source 14 and the transistor 132 has its emitter connected to the solenoid 10. The gate to solenoid potential of the transistor 136 is thus small. Therefore, when the line 72 output has a value of "0", the transistor 136 is not conductive, and no current can flow from the power source 14 through the solenoid 10.

However, when the line 72 output has a value of "0", the capacitor 126 will charge up to a potential approaching that of the power source 14 through a diode 144. When the line 72 output switches to a value of "1", the transistors 132 and 134 become non-conductive, allowing the charged potential on the capacitor 126 to be fed to the gate of the transistor 136 through the transistor 130. Consequently, transistor 136 becomes conductive, allowing current to flow from the power source 14 through the solenoid 10. Therefore, as described above, when the line 72 output has a value of "1", the power source 14 supplies current to the solenoid 10, and when the line 72 output has a value of "0", the power source 14 is isolated from the solenoid 10.

The freewheel switch 22 and the variable resistance 124 are both provided by the circuit including a second inverter 146, an on-off current source 148, an NPN transistor 150, an N channel MOSFET transistor 152, and a zener diode 154. For a solenoid current decay rate identical to that for the circuit shown in FIG. 11, the breakdown potential of the zener diode 154 is selected to be $$E_{z154}=E_{z32}-E_{th},$$

wherein $E_{z154}$ is the breakdown potential of the zener diode 154, $E_{z32}$ is the breakdown potential of the zener diode 30 shown in FIG. 12, and $E_{th}$ is the gate to source threshold potential of the transistor 152. The second inverter 146 inverts the line 74 output from the controller stage 68 described above to provide an inverted value of the line 74 output to the current source 148. Therefore, when the line 74 output has a value of "0", the current source 148 is turned on. The current source 148 feeds the base of the transistor 150, keeping it conductive while the line 74 output has a value of "0". The transistor 150 has it collector connected to the gate of the transistor 152 through a resistor 156. The gate of the transistor 152 is also fed to the power source 14 through the parallel combination of a resistor 158 and the zener diode 154. Since the emitter of the transistor 150 is connected to the solenoid 10, the potential on the gate of the transistor 152 is approximately the potential on the solenoid 10. Thus, the gate to source potential is nearly zero, hence the transistor 152 is non-conducting. When the potential across the solenoid 10 drops to a level lower than the level of the power source 14 less the breakdown potential of the zener diode 154, the zener diode 154 begins to conduct, holding the potential on the gate of the transistor 152 at a potential corresponding to that of the power source 14 less the breakdown potential of the zener diode 154. Thus, as the solenoid potential becomes more negative, the transistor 152 begins to conduct, thus slowing the solenoid field collapse while holding the solenoid 10 at a constant potential. This is the equivalent of the freewheel switch 22 being opened in the Table.

When the line 74 output has a value of "1", the transistor 150 becomes non conducting, and the transistor 152 then becomes fully conducting because its gate potential is pulled up through the resistor 158. Accordingly, when the line 74 output has a value of "1", the potential across the solenoid 10 drops to approximately the inverse of the potential drop across the diode 20. Both the transistors 136 and 152 are of the N channel variety to minimize channel resistance, and thus circuit loss.

Therefore, the power loss in the transistor 136 is less when it conducts, since its channel resistance is less than the P channel transistor 116 in the circuit of FIG. 12. Furthermore, power loss in the freewheel switch 22 and the variable resistor 124 combination circuitry is less when the line 74 output has a value of "0" because it is reduced by the current of the solenoid 10 multiplied by the power source 14 potential. It is also less when the line 74 output has a value of "1" because it is simply the solenoid 10 current multiplied by the potential drop across the transistor 152 and the Shottky diode 20, which is much lower than the transistor 120 saturation potential and the potential drop across a conventional diode 20.

There have been described above methods and apparatus for solenoid driver system control which supply a measured high level of solenoid drive current for a determined period to actuate a solenoid operated actuator followed by a lower level solenoid hold current for maintaining actuation of the solenoid operated actuator, combining high efficiency with rapid rate of response. It will be understood that various changes in the details, arrangements and configurations of the parts and systems which have been herein described and illustrated in order to explain the nature of the invention may be made by those skilled in the art within the principle and scope of the invention as expressed in the appended claims.

TABLE

| Mode | Power Sw. 124 | Freewheel Sw. 22 | FIG. 8 Region | Function |
|---|---|---|---|---|
| One | Opened | Opened | 48–50 | Solenoid current equals zero. |
| Two | Closed | Closed | 50–52 | Solenoid current rises to desired maximum level. |
| Three | Cycled Opened and Closed | Closed | 52–54 | Solenoid current rises and falls between desired minimum and maximum level. |
| Four | Open | Opened | 54–56 | Solenoid current decays to desired minimum holding level. |
| Five | Cycled Opened and Closed | Closed | 56–58 | Solenoid current rises and falls between desired minimum and maximum holding level. |
| Six | Opened | Opened | 58–60 | Solenoid current decays to zero. |

What is claimed is:

1. For a solenoid operated valve actuator control system, a method of proportioning unidirectional actuator solenoid current in response to an actuator control signal, comprising the steps of:

sensing a control signal for actuation of an actuator having a solenoid operator;

supplying current to said solenoid in response to said control signal;

sensing the level of current applied to said solenoid;

periodically interrupting said supplied current to said solenoid to provide a prescribed current acceleration level in response to said sensed solenoid current for a prescribed solenoid acceleration period to move said actuator to an actuated position from a released position;

reducing said solenoid current at a prescribed rate after said solenoid drive period has expired;

periodically interrupting said supplied current to said solenoid to provide a prescribed current holding level less than said prescribed current acceleration level in response to said sensed solenoid current for a holding period sensed from said control signal, to hold said actuator in said actuated position for said holding period; and reducing said solenoid current at said prescribed rate after the expiration of said holding period to return said actuator to said released position.

2. The method recited in claim 1, wherein said step of periodically interrupting said supplied current to said solenoid at said prescribed acceleration level for said prescribed acceleration period includes the step of selecting said acceleration period to be as long as required to fully actuate said actuator.

3. The method recited in claim 2, wherein said step of sensing said solenoid current includes the step of applying resistance to said solenoid current to produce a feedback signal across said resistance with a potential proportional to said solenoid current.

4. The method recited in claim 3, wherein said step of periodically interrupting said supplied current to provide said maximum acceleration level includes interrupting said supplied current in periodic intervals according to the potential of said feedback signal over a first prescribed feedback signal level.

5. The method recited in claim 4, wherein said step of periodically interrupting said supplied current to provide said maximum holding level includes interrupting said supplied current in periodic intervals according to the potential of said feedback signal over a second prescribed feedback signal level.

6. The method recited in claim 5, wherein said step of reducing said solenoid current after expiration of said holding period includes the steps of:

removing said supplied current from said solenoid;

discharging said solenoid current at said prescribed rate until said solenoid current reaches a prescribed minimum holding level; and reapplying current to said solenoid at said prescribed minimum current holding level.

7. The method recited in claim 6, wherein said step of reducing said solenoid current after expiration of said holding period includes the steps of:

removing said supplied current from said solenoid; and discharging said solenoid current at said prescribed rate.

8. The method recited in claim 7, wherein said step of sensing said control signal includes sensing the pulse duration of a pulse width modulated control signal.

9. In a solenoid operated valve actuator control system, apparatus for proportioning unidirectional actuator solenoid current in response to an actuator control signal, comprising:

means for sensing a control signal for actuation of an actuator having a solenoid operator;

means for supplying current to said solenoid in response to said control signal;

means for sensing the level of current applied to said solenoid;

means for periodically interrupting said supplied current to said solenoid to a prescribed current acceleration level in response to said sensed solenoid current for a prescribed solenoid acceleration period to move said actuator to an actuated position from a released position;

means for reducing said solenoid current at said prescribed rate after said solenoid acceleration period has expired;

means for periodically interrupting said supplied current to said solenoid to a prescribed current holding level less than said prescribed acceleration current level in response to said sensed solenoid current for a holding period sensed from said control signal, to hold said actuator in said actuated position for said holding period; and means for reducing said solenoid current at said prescribed rate after the expiration of said holding period to return said actuator to said released position.

10. The apparatus recited in claim 9, wherein said means for periodically interrupting said supplied current to said solenoid to said prescribed acceleration level for said prescribed acceleration period regulates said solenoid current at said prescribed acceleration level as long as required to fully actuate said actuator.

11. The apparatus recited in claim 10, wherein said means for sensing said solenoid current includes a solenoid circuit resistance to produce a feedback signal across said resistance with a potential proportional to said solenoid current.

12. The apparatus recited in claim 11, wherein said means for periodically interrupting said supplied current to said solenoid to said prescribed current acceleration level interrupts said supplied current in periodic intervals proportional to the potential of said feedback signal over a first prescribed feedback signal level.

13. The apparatus recited in claim 12, wherein said means for periodically interrupting said supplied current to said solenoid to said prescribed holding level interrupts said applied current in periodic intervals proportional to the potential of said feedback signal over a second prescribed feedback signal level.

14. The apparatus recited in claim 13, wherein said means for reducing said solenoid current after expiration of said acceleration period removes said supplied current to said solenoid and discharges said solenoid current at said prescribed rate until said solenoid current reaches a prescribed minimum holding level.

15. The apparatus recited in claim 14, wherein said means for reducing said solenoid current after expiration of said holding period interrupts said applied current to said solenoid and discharges said solenoid current at said prescribed rate.

16. The apparatus recited in claim 15, wherein said means for sensing said control signal senses the pulse duration of a pulse width modulated control signal.

17. Apparatus for controlling current applied to a solenoid for a solenoid operated valve actuator in response to an actuator control signal and solenoid current to proportion said solenoid current, comprising:

means for supplying current to said solenoid;

means for sensing a control signal for actuation of said solenoid;

means for sensing current in said solenoid;

means for periodically interrupting current to said solenoid from said means for supplying current;

means for reducing said solenoid current; and means for controlling said means for periodically interrupting and means for reducing in response to said control signal and said solenoid current.

18. The apparatus recited in claim 17, wherein said means for supplying includes a current source.

19. The apparatus recited in claim 18, wherein said means for periodically interrupting includes a switching circuit for periodically interrupting a current source path between said current source and said solenoid to provide a current acceleration level and a current holding level.

20. The apparatus recited in claim 19, wherein said means for periodically interrupting further includes a switchable current loop for said solenoid current which is closed when said current source path is interrupted.

21. The apparatus recited in claim 20, wherein said means for reducing includes a switchable resistive current loop for said solenoid current.

22. The apparatus recited in claim 21, wherein said means for solenoid current sensing includes a resistance inserted in said solenoid current for developing a feedback potential signal.

23. The apparatus recited in claim 22, wherein said means for control signal sensing includes a pulse width detector circuit for sensing the duration of width modulated pulses in said actuator control signal.

24. The apparatus recited in claim 23, wherein said means for controlling includes a controller for closing said current source switching circuit upon sensing a leading edge of a width modulated control s pulse.

25. The apparatus recited in claim 24, wherein said controller further includes a first comparator for comparing said feedback potential signal with a reference acceleration level potential for a prescribed acceleration period after sensing a leading edge of said width modulated control signal pulse, and said controller opens said switching circuit whenever said feedback potential signal exceeds said reference acceleration level potential.

26. The apparatus recited in claim 25 wherein said controller opens said switching circuit and said switchable current loop and closes said switchable resistive current loop after said prescribed acceleration period, and said controller further includes a second comparator for comparing said feedback potential signal with a reference holding level potential for the duration of said width modulated control signal pulse after said prescribed acceleration period expires, and said controller opens said switchable resistive current loop when said feedback signal potential falls below said reference holding, level potential.

27. The apparatus recited in claim 26, wherein said controller closes said switching circuit and said switchable current loop after said feedback signal potential falls below said reference holding level potential.

28. The apparatus recited in claim 27, wherein said controller opens said switching circuit when said feedback signal potential exceeds said reference holding potential after said prescribed acceleration.

29. The apparatus recited in claim 28, wherein said controller opens said switching circuit and said switchable current loop and closes said resistive switchable current loop after the duration of said width modulated control signal pulse expires.

30. The apparatus recited in claim 29, wherein said switching circuit includes a MOSFET switch.

31. The apparatus recited in claim 30, wherein said switchable current loop includes a transistor switched diode.

32. The apparatus recited in claim 31, wherein said resistive switchable current loop includes a zener diode.

33. The apparatus recited in claim 32, wherein said zener diode is switched by said switching circuit.

34. The apparatus recited in claim 33, wherein said zener diode has a prescribed breakdown potential to provide a corresponding solenoid current decay rate.

35. The apparatus recited in claim 34, wherein said switching circuit MOSFET switch is an N-channel type.

36. The apparatus recited in claim 35, wherein said switchable current loop includes an N-channel MOSFET switched Schottky diode.

37. The apparatus recited in claim 36, wherein said switchable resistive current loop is said switchable current loop with said current loop switching MOSFET biased to have a prescribed channel resistance to provide a corresponding solenoid current decay rate.

38. Apparatus for actuating a valve in response to an actuator control signal and solenoid current, comprising:

a solenoid actuator including at least one low inductance solenoid coil, a laminated armature and a laminated stator;

a current source for supplying current to said solenoid;

a pulse width detector circuit for sensing the duration of a pulse width modulated actuator control signal;

a solenoid circuit resistance for developing a feedback potential signal;

a switching circuit for periodically interrupting current to said solenoid from said current source;

a switchable resistive current loop for controllably reducing current in said solenoid; and a controller circuit for controlling said switching circuit and said switchable resistive current loop in response to said pulse width modulated control signal and said feedback signal to actuate said solenoid actuator at high speed with minimal average solenoid current.

39. The apparatus recited in claim 38, wherein said solenoid actuator includes an "E" type stator configuration.

40. The apparatus recited in claim 39, wherein said solenoid stator has a single said solenoid coil wound around its central pole piece.

41. The apparatus recited in claim 38, wherein said solenoid actuator includes a "C" type stator configuration.

42. The apparatus recited in claim 41, wherein said solenoid stator has a single said solenoid coil wound around its yoke.

43. The apparatus recited in claim 42, wherein said solenoid coil comprises 26 coil turns around said stator yoke.

44. The apparatus recited in claim 41, wherein said solenoid stator has one said solenoid coil wound around each pole piece of said stator.

45. The apparatus recited in claim 44, wherein said solenoid coil comprises 13 coil turns around each corresponding pole piece.

46. The apparatus recited in claim 38, wherein said stator and said armature each includes a stacked plurality of ferromagnetic plates.

47. The apparatus recited in claim 38, wherein said ferromagnetic plates each have a thickness up to about 0.014 inch thick.

48. The apparatus recited in claim 38, wherein said stator and said armature are each on the order of 0.25 inch thick.

49. The apparatus recited in claim 38, wherein said armature and said stator each include multiple layers of ferromagnetic tape.

50. The apparatus recited in claim 38, wherein said solenoid actuator includes a current rise time substantially less than its armature response time.

* * * * *